US005534334A

United States Patent [19]

Hama et al.

[11] Patent Number: 5,534,334

[45] Date of Patent: Jul. 9, 1996

[54] BASE FABRIC FOR INK RIBBONS

[75] Inventors: Kenji Hama; Nobutake Hiroe; Junko Kuroda, all of Shiga-ken, Japan

[73] Assignee: Toray Industries, Inc., Japan

[21] Appl. No.: 232,184

[22] PCT Filed: Sep. 3, 1993

[86] PCT No.: PCT/JP93/01251

§ 371 Date: May 3, 1994

§ 102(e) Date: May 3, 1994

[87] PCT Pub. No.: WO94/05504

PCT Pub. Date: Mar. 17, 1994

[30] Foreign Application Priority Data

Sep. 10, 1992 [JP] Japan ..... 4-241746

[51] Int. Cl.[6] ..... D03D 3/00

[52] U.S. Cl. ..... 428/224; 428/220; 428/221; 428/195; 428/378; 57/243; 57/260; 57/282

[58] Field of Search ..... 428/195, 198, 428/378, 221, 224, 220; 264/210, 290, 342, 103, 143, 171; 57/140 BY, 157, 140 R, 243, 260

[56] References Cited

U.S. PATENT DOCUMENTS

| | | | |
|---|---|---|---|
| 3,707,593 | 12/1972 | Fukada et al. | 264/210 |
| 3,771,307 | 11/1973 | Petrille | 57/34 |
| 3,840,630 | 10/1974 | Yamada | 264/210 |
| 3,846,532 | 11/1974 | Kubitzker et al. | 264/210 |
| 3,857,233 | 12/1976 | Cardinal et al. | 57/157 |
| 4,019,311 | 4/1977 | Schippers | 57/140 |
| 4,035,464 | 7/1977 | Kubitzek et al. | 264/103 |
| 4,049,763 | 9/1977 | Mineo et al. | 264/176 F |
| 4,093,147 | 6/1978 | Bromley et al. | 242/159 |
| 4,229,500 | 10/1980 | Adachi et al. | 264/210.8 |
| 4,874,263 | 10/1989 | McCall | 400/241.3 |
| 5,173,360 | 12/1992 | Hiroe et al. | 428/373 |

FOREIGN PATENT DOCUMENTS

| | | |
|---|---|---|
| 3-34883 | 2/1991 | Japan . |
| 3-73378 | 3/1991 | Japan . |

*Primary Examiner*—Patrick J. Ryan
*Assistant Examiner*—Merrick Dixon
*Attorney, Agent, or Firm*—Austin R. Miller

[57] ABSTRACT

The present invention relates to base fabrics for ink ribbons used in impact printers, not allowing the graphic spots to occur.

They are woven fabrics composed of synthetic multi-filament yarns, the warp of which are 30 to 50 D in yarn thickness and 330 T/M to 600 T/M in the number of twist.

4 Claims, 1 Drawing Sheet

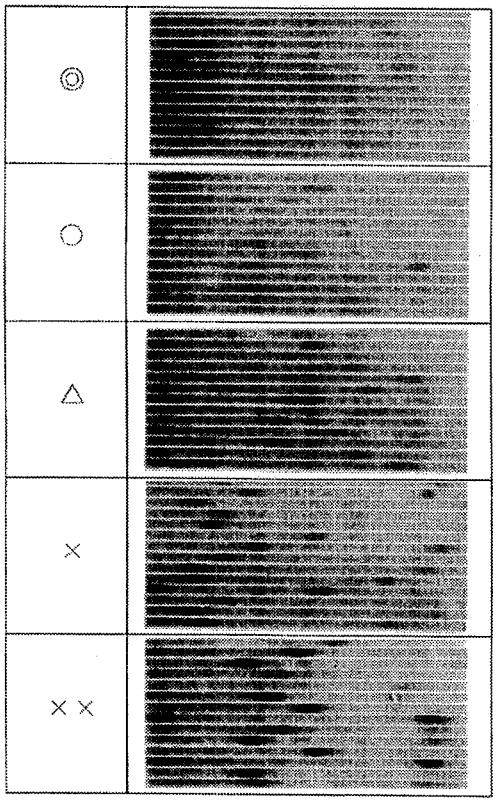

FIG. 1

| | |
|---|---|
| ◎ | [redacted] |
| ○ | [redacted] |
| △ | [redacted] |
| × | [redacted] |
| × × | [redacted] |

BASE FABRIC FOR INK RIBBONS

TECHNICAL FIELD

The present invention relates to base fabrics for ink ribbons used in impact printers.

BACKGROUND ARTS

In recent years, the conventional spool type ink ribbons used in impact printers are being increasingly substituted by cassette type ink ribbons. A cassette type ink ribbon is folded to be contained in the narrow space of a cassette. When the cassette type ink ribbon is used for printing by a printer, the characters printed at the folds become disadvantageously darker than those printed at the other portions of the ink ribbon. The more darkly printed spots are called graphic spots. In recent years, new types of printers quite free from the graphic spots such as laser printers, heat transfer printers and ink jet printers are being marketed, and in this connection, there is an increasing demand for base fabrics for ink ribbons not allowing the graphic spots to occur. To meet the demand, a technique for lessening the graphic spots by disordering the array of monofilaments by high pressure fluid treatment to enhance the ink absorbability is proposed in Japanese Patent Laid-Open No. 91-281277, and techniques for lessening the graphic spots by specifying the weave are proposed in Japanese Patent Laid-Open Nos. 91-34883 and 91-73378.

However, the high pressure fluid treatment proposed as a means for enhancing the ink absorbability of the base fabric requires expensive and additional equipment investment and increases the number of production steps, to considerably raise the cost. The techniques for specifying the weave of the base fabric cannot be said to be satisfactory in the effect to lessen the graphic spot's, and since the weave is loose, the fabric is liable to be caught by the head pins of a serial dot printer as a problem in view of practical use.

DISCLOSURE OF THE INVENTION

The object of the present invention is to present base fabrics for ink ribbons not allowing the graphic spots to occur. To achieve the object, the present invention adopts the following means.

The base fabrics for ink ribbons of the present invention are woven fabrics composed of synthetic multi-filament yarns, comprising the warp used for forming the woven fabrics, being 30 to 50 D (deniers) in yarn thickness and 330 T/M to 600 T/M in the number of twist.

The present invention presents ink ribbons with an excellent property of not allowing the graphic spots to occur, by specifying the number of twist of the warp used for forming the base fabrics.

In addition to not allowing the graphic spots to occur, the base fabrics for ink ribbons of the present invention can well catch the ink and are good in ink permeability, since the yarn surfaces are made more rugged by keeping the number of twist in said range.

The inventors also examined the relation between the number of twist of weft and the graphic spots, and found that the number of twist of weft is irrelevant to the graphic spots. The weft used for forming the woven base fabric for ink ribbons of the present invention can be of any number of twist, and can be even without twist.

In the present invention, the larger the number of twist of warp, the less outstanding the graphic spots. The number of twist of warp in the present invention should be in a range from 330 T/M to 600 T/M, preferably 350 T/M to 500 T/M. If it is less than 330 T/M, the effect of lessening the graphic spots is inssuficient, and if more than 600 T/M, the graphic spots are not lessened relatively to the cost hike.

In general, the yarns used as the warp and the multi-filament yarns used as the weft to form a woven base fabric for ink ribbons are additionally twisted. The twisting machine used is generally a double twister, but the present invention is not limited thereto or thereby.

The twisting speed of the twisting machine depends on the speed of the spindle of the twisting machine, but is usually recommended to be 9000 to 10000 rpm, and the ballooning tension in this case should be preferably 0.4 to 0.5 g/d. But the present invention is not limited thereto or thereby.

The synthetic filaments used in the present invention are preferably polyamide filaments, but the present invention is not limited thereto or thereby.

In the case of polyamide multi-filament yarns, the titanium oxide content should be preferably 0.15 wt% or less, more preferably 0.10 wt% or less, especially more preferably 0.06 wt% or less. If the titanium oxide content is more than 0.15 wt%, the durability at the welding point and of the base fabric is lowered.

The yarn thickness of the warp should be preferably 30 to 50 D in view of the durability of the base fabric.

When the number of twist of the warp is in the range specified in the present invention, it is recommended to set the twist since the yarn untwisting caused by twist torque during weaving does not occur to assure higher weavability, but the present invention is not limited thereto or thereby.

The twist setting can be weak as far as the yarn untwisting does not occur during warping or weaving, and should be preferably effected at a temperature as low as possible, for example, at wet heat 60° C. for about 2 hours, but the present invention is not limited thereto or thereby.

The base fabrics for ink ribbons of the present invention can have been processed with a resin, or treated by a surfactant, plasma or high pressure fluid.

The woven base fabrics for ink ribbons can be of plain weave, modified plain weave, twill weave or satin weave, etc., but the present invention is not limited thereto or thereby.

As for the weave density of the woven fabrics, the number of yarns used as the warp can be approximately 130 to 400 per inch, preferably 140 to 350 per inch, and the number of yarns used as the weft, 100 to 230 per inch, preferably 110 to 200 per inch.

The base fabrics for ink ribbons of the present invention allow the graphic spots to occur less excellently, compared to the conventional base fabrics formed by using warp of about 100 to 280 T/M in the number of twist or those improved by specifying the weave. Furthermore, compared to the base fabrics improved by high pressure fluid treatment, the present invention does not require any additional equipment investment, and so is advantageous in view of cost.

The base fabrics for ink ribbons of the present invention are impregnated with a proper amount of an ordinary oil ink, to be formed into ink ribbons.

The ink ribbons thus produced do not allow any graphic spots to occur at all, and allow the conventional equipment to be used. Therefore, they are excellent as cassette type ink ribbons which can be produced at low production cost.

BRIEF DESCRIPTION OF THE DRAWING

FIG. 1 contains printed images obtained in the examples of the present invention.

THE BEST MODE FOR CARRYING OUT THE INVENTION

The present invention is described below in more detail in referance to examples, but is not limited thereto or thereby. Nylon 66 multi-filament yarns of 40 deniers/34 filaments were additionally twisted to 250, 300, 330, 350, 400, 500, 600 and 1000 T/M for use as yarns of warp, and yarns of 40 deniers/34 filaments not additionally twisted were used as weft, for weaving plain weave fabrics.

The plain weave fabrics were degummed as usual, and finished by a pin tenter, to prepare the woven fabrics shown in Table 1.

These woven fabrics were heat cut at a width of 13 mm, for use as base fabrics for ink ribbons. These base fabrics were impregnated with an oil ink by 22 wt% based on the weight of each base fabric, to prepare ink ribbons for dot printers.

The ten meters each of the ink ribbons prepared was contained in a ribbon cassette for 9-pin dot printer (M-1550 produced by Tokyo Electric Co., Ltd.) which was set in a dot printer, for solid printing. The graphic spot level was judged with eyes.

The criterion was as follows. The actually printed images are shown in FIG. 1.

oo: No spot occurred at all.

o: Few spots occurred.

Δ: Light spots occurred.

x: Dark spots occurred xx: Very dark spots occurred.

The results are shown in Table 1.

TABLE 1

| | Count of twist of warp | Density (yards/in) | | Thickness of base | Gracphic spot |
|---|---|---|---|---|---|
| | (T/M) | Warp | Weft | fabric (μm) | level |
| Present invention example 1 | 330 | 209 | 123 | 128 | Δ |
| Present invention example 2 | 350 | 210 | 123 | 129 | Δ |
| Present invention example 3 | 400 | 210 | 124 | 130 | oo |
| Present invention example 4 | 500 | 210 | 124 | 131 | oo |
| Present invention example 5 | 600 | 210 | 124 | 132 | oo |
| Comparative example 1 | 250 | 208 | 123 | 128 | xx |
| Comparative example 2 | 300 | 209 | 123 | 129 | x |
| Comparative example 3 | 1000 | 210 | 124 | 143 | oo |

As can be seen from Table 1, the ink ribbons of Present Invention Examples 3 to 6 did not allow the graphic spot to occur at all, and could provide excellently uniform printing.

The ink ribbons of Present Invention Examples 1 and 2 allowed light graphic spots to occur.

The ink ribbons of Comparative Examples 1 and 2 allowed practically unpreferable dark graphic spots to occur.

INDUSTRIAL APPLICABILITY

The base fabrics for ink ribbons of the present invention can be used as cassette type ink ribbons in various impact printers such as line printers and serial printers, since no graphic spots are allowed to occur even if the ink ribbons are folded to be contained in the cassettes, and so are expected to be highly demanded.

We claim:

1. A woven fabric for ink ribbons, composed of synthetic multi-filament yarns, comprising the warp used to form the woven fabrics, being 30 to 50 D in yarn thickness and 330 to 600 T/M in the number of twist.

2. The woven fabric for ink ribbons according to claim 1, wherein the warp are 350 to 500 T/M in the number of twist.

3. The woven fabric for ink ribbons according to claim 1, wherein the multi-filament yarns are polyamide multi-filament yarns.

4. The woven fabric for ink ribbons according to claim 1, wherein the ink ribbons are of a cassette type.

* * * * *